US005944006A

United States Patent [19]

Moore et al.

[11] Patent Number: 5,944,006

[45] Date of Patent: Aug. 31, 1999

[54] TOY GUN WITH A SELECTIVELY EXTENDABLE BARREL

[75] Inventors: Michael A. Moore; Teresa A. Hartman, both of Cincinnati, Ohio; David R. Griffin, Morning View, Ky.; Kenneth L. Miller, Indian Springs, Ohio

[73] Assignee: Hasbro, Inc., Pawtucket, R.I.

[21] Appl. No.: 09/058,626

[22] Filed: Apr. 9, 1998

[51] Int. Cl.[6] ..... F41B 11/14

[52] U.S. Cl. ..... 124/65; 124/80; 124/83; 124/67; 42/54; 42/73

[58] Field of Search ..... 124/55, 65, 80, 124/83, 67; 42/54, 73

[56] References Cited

U.S. PATENT DOCUMENTS

| | | | |
|---|---|---|---|
| D. 295,058 | 4/1988 | Turner, Jr. | D21/146 |
| 1,052,123 | 2/1913 | Bennett | 124/66 |
| 2,433,151 | 12/1947 | Parsons | 42/72 |
| 2,741,872 | 4/1956 | Sigg | 46/175 |
| 3,123,928 | 3/1964 | Lizza | 42/72 |
| 3,267,600 | 8/1966 | Ryan | 42/54 |
| 3,267,923 | 8/1966 | Ronci | 124/30 |
| 3,346,984 | 10/1967 | Lohr | 42/55 |
| 3,618,249 | 11/1971 | Grandy | 42/73 |
| 3,765,396 | 10/1973 | Kienholz et al. | 124/67 |
| 4,571,201 | 2/1986 | Matsuda | 446/85 |
| 4,575,352 | 3/1986 | Matsuda | 446/376 |
| 4,625,706 | 12/1986 | Turner, Jr. | 124/67 |
| 4,732,136 | 3/1988 | Ferri | 124/67 |
| 4,735,007 | 4/1988 | Gal | 42/72 |
| 5,367,812 | 11/1994 | Lautrec | 42/74 |
| 5,724,954 | 3/1998 | Smith | 124/66 |
| 5,791,326 | 8/1998 | Brown et al. | 124/66 |

FOREIGN PATENT DOCUMENTS 412580 6/1934 United Kingdom .

*Primary Examiner*—J. Woodrow Eldred
*Attorney, Agent, or Firm*—Marshall, O'Toole, Gerstein, Murray & Borun

[57] ABSTRACT

A toy gun is disclosed. In one embodiment, the toy gun includes a housing, a barrel coupled to the housing for movement between retracted and extended positions, and a stock for movement between retracted and extended positions. In another embodiment, the toy gun includes a chamber; a device for forcing air from the chamber; a barrel coupled to the housing for movement between retracted and extended positions; and a seal for directing air forced from the chamber through the barrel.

37 Claims, 7 Drawing Sheets

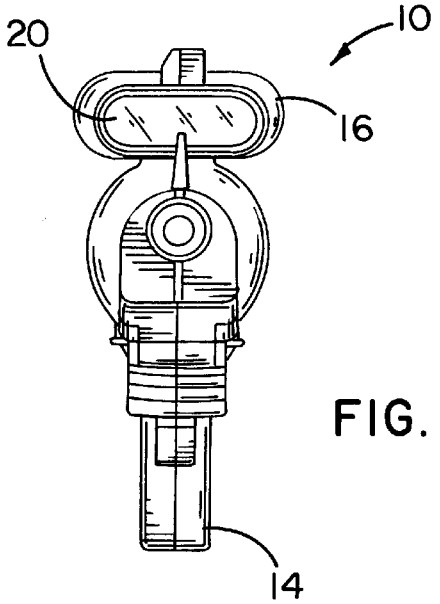
FIG. 5
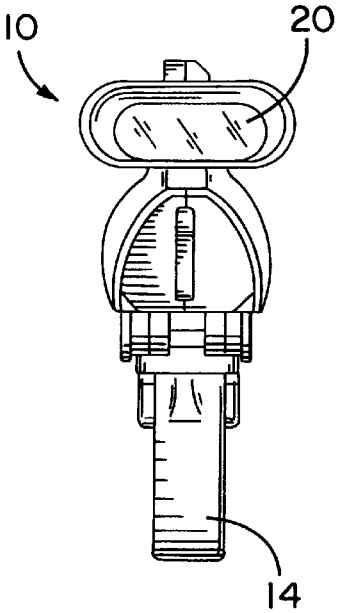
FIG. 6
FIG. 12
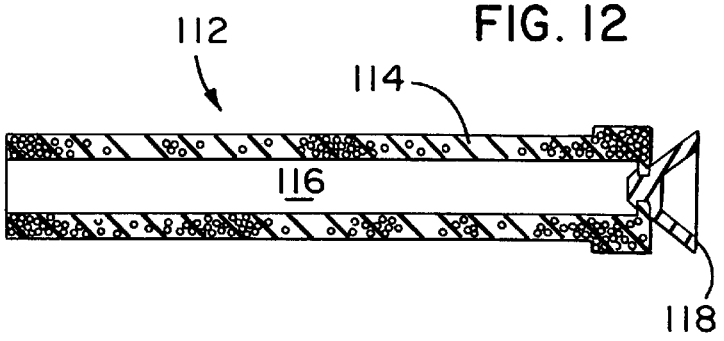

TOY GUN WITH A SELECTIVELY EXTENDABLE BARREL

FIELD OF THE INVENTION

The present invention relates generally to toy guns and, more particularly, to a toy gun with a selectively extendable barrel.

BACKGROUND OF THE INVENTION

For many years, toy guns have been very popular with children of various ages. Some of the earliest and crudest toy guns consisted of little more than a block of wood carved to resemble a real gun. Over time many efforts have been made to develop improved toy guns that better capture and hold the attention of children. Through this process, more sophisticated toys have been developed.

For example, in recent years, toy guns which launch harmless projectiles have become popular. In one example of such guns, soft foam projectiles are launched by a blast of air developed by a reciprocating plunger contained within a toy gun housing. These guns are advantageous in that the projectiles and the air blast developed by the reciprocating plunger are harmless, and the moving plunger is safely contained within the housing thereby ensuring that no injury can result from use of the toy.

The toy market changes rapidly. Children are constantly interested in toys with new features. Therefore, it is desirable to develop new toy guns with new functions and features which will capture the interest of children and provide increased play value.

SUMMARY OF THE INVENTION

In accordance with an aspect of the invention, the present invention improves upon the prior art by providing a toy gun which includes a housing defining a chamber; means for forcing air from the chamber; a barrel which is coupled to the housing for movement between a retracted position and an extended position; and a seal. The barrel has a first end in communication with the chamber and a second end opposite the first end. The second end is adapted for receiving a projectile. The first end is in communication with the second end. The seal is associated with the barrel and ensures that a substantial portion of the air forced from the chamber by the forcing means is communicated through the first end of the barrel to the second end of the barrel for applying forced air to a received projectile.

In some embodiments, the toy gun is further provided with a stock coupled to the housing for movement between a stock retracted position and a stock extended position. The toy gun can also be provided with a stock spring for biasing the stock towards the stock extended position and a stock latch for releasably securing the stock in the stock retracted position. The toy gun may also be provided with a barrel spring positioned within the housing to bias the barrel towards the extended position and/or a barrel latch for releasably securing the barrel in the retracted position. In some embodiments, a latch is provided. In such instances, the latch is preferably in operative engagement with the stock latch for selectively releasing the stock for movement from the stock retracted position to the stock extended position and/or in operative engagement with the barrel latch for selectively releasing the barrel for movement from the retracted position to the extended position.

In accordance with another aspect of the invention, a toy gun is provided which includes: a housing; a barrel coupled to the housing for movement between a retracted position and an extended position; a stock coupled to the housing for movement between a stock retracted position and a stock extended position; and a single actuator for selectively permitting the barrel to move to the extended position and the stock to move to the stock extended position. In some embodiments, the barrel is substantially disposed within the housing when the barrel is located in the retracted position, and the barrel is substantially disposed outside of the housing when the barrel is located in the extended position. Preferably, the movement of the barrel between the extended and retracted positions is substantially linear.

In any of the foregoing embodiments, the toy gun may be further provided with a barrel spring positioned within the housing to bias the barrel towards the extended position and/or a barrel latch for releasably securing the barrel in the retracted position. The toy gun may also be provided with a stock spring for biasing the stock towards the stock extended position and/or a stock latch for releasably securing the stock in the stock retracted position.

In some preferred embodiments, the toy gun is also provided with a latch in operative engagement with the stock latch for selectively releasing the stock for movement from the stock retracted position to the stock extended position and/or in operative engagement with the barrel latch for selectively releasing the barrel for movement from the retracted position to the extended position. In some preferred embodiments, the latch is coupled to a handle which is pivotably mounted on the housing, and pivoting the handle through a predefined angle releases the stock for movement from the stock retracted position to the stock extended position and the barrel for movement from the retracted position to the extended position.

In any of the above embodiments, the barrel can be located at a distal end of the housing and the stock can be located at a proximal end of the housing such that, when the barrel is in the extended position and the stock is in the stock extended position, the barrel and the stock extend from opposite ends of the housing.

In accordance with still another aspect of the invention, an apparatus is provided for use in a toy gun having first and second movable elements. The first element is movable between first and second positions and the second element is movable between third and fourth positions. The apparatus comprises a first pivot arm in operative engagement with the first element to releasably secure the first element in the first position; and a second pivot arm in operative engagement with the second element to releasably secure the second element in the third position. It also includes a compound latch having a first surface in operative engagement with the first pivot arm and a second surface in operative engagement with the second pivot arm. The first and second surfaces of the compound latch are located such that, when the compound latch is sufficiently pivoted, the first surface applies a pivoting force to the first pivot arm and the second surface applies a pivoting force to the second pivot arm to thereby cause the first and second pivot arms to release the first and second elements for movement to the second and fourth positions, respectively.

In the preferred embodiment, the first element comprises a barrel for the toy gun and the second element comprises a stock for the toy gun.

Other features and advantages are inherent in the apparatus claimed and disclosed or will become apparent to those skilled in the art from the following detailed description and its accompanying drawings.

BRIEF DESCRIPTION OF THE DRAWINGS

FIG. 5 is a front view of the device of FIG. 1.

FIG. 6 is a rear view of the device of FIG. 1.

FIG. 12 is a cross-sectional view of a projectile for use with the gun of FIG. 1.

DESCRIPTION OF THE PREFERRED EMBODIMENTS

Figure 1:
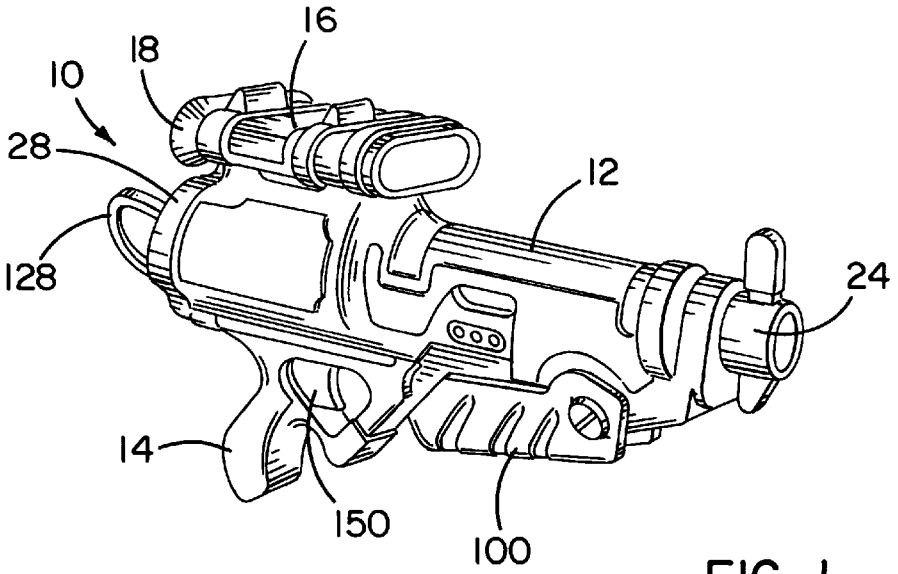
FIG. 1 is a left, front perspective illustration of a toy gun constructed in accordance with the teachings of the present invention.
Figure 2:
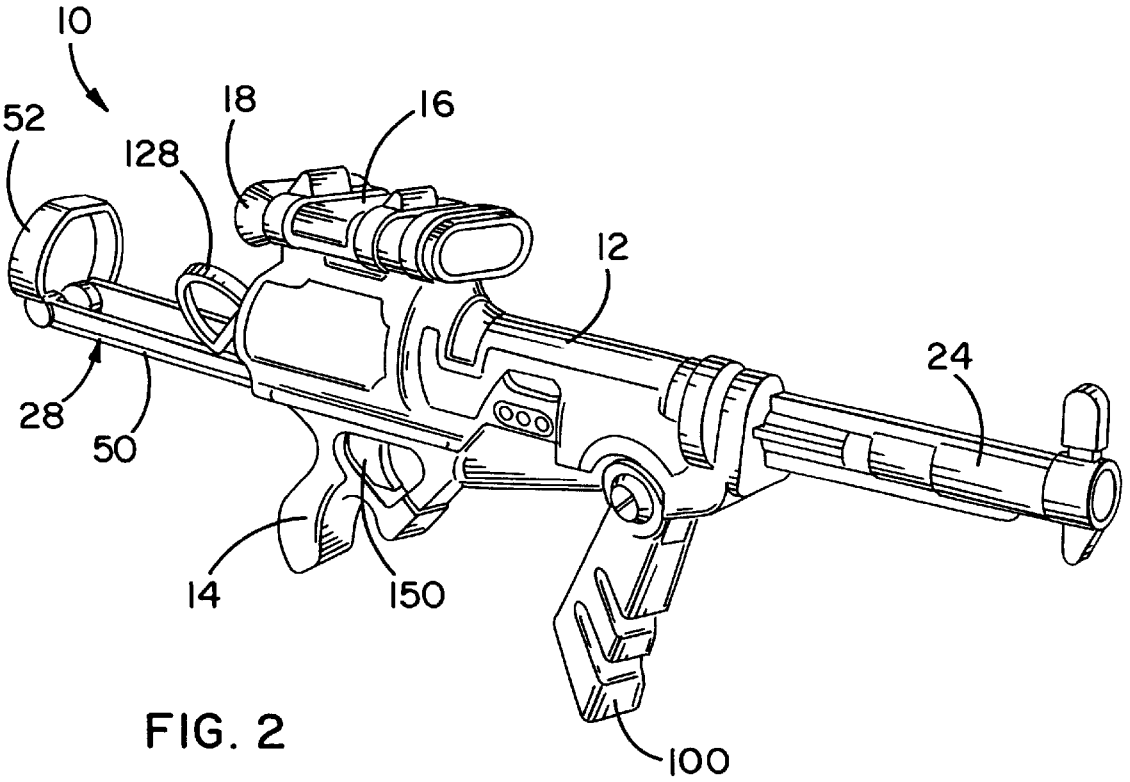
FIG. 2 is a view similar to FIG. 1, but showing the barrel and stock of the gun in their extended positions.

A toy gun 10 constructed in accordance with the teachings of the instant invention is illustrated in FIGS. 1 and 2. Although in the illustrated embodiment, the gun 10 is adapted for shooting harmless projectiles with a blast of air, persons of ordinary skill in the art will appreciate that the teachings of the invention are not limited to toy guns which shoot projectiles or to any other particular type of toy gun. On the contrary, the teachings of the invention are applicable to any toy gun which would benefit from one or more of the features disclosed herein.

As shown in FIG. 1, the toy gun 10 is preferably provided with a housing 12 shaped to visually resemble a gun. To this end, the housing 12 includes a housing handle 14 and a site 16. The housing handle 14 provides a grip to facilitate holding and firing the gun 10. Preferably, the site 16 comprises a hollow cylindrical member which permits a user to optionally look through the site 14 when aiming the gun 10. To facilitate such siting, the site 16 preferably includes a pliable eye cup 18 which, in the preferred embodiment, is made from rubber. As shown in FIGS. 5 and 6, each of the ends of the site 14 preferably includes a clear plastic lens 20 to further enhance the simulation of looking through a site 14.

Figure 3:
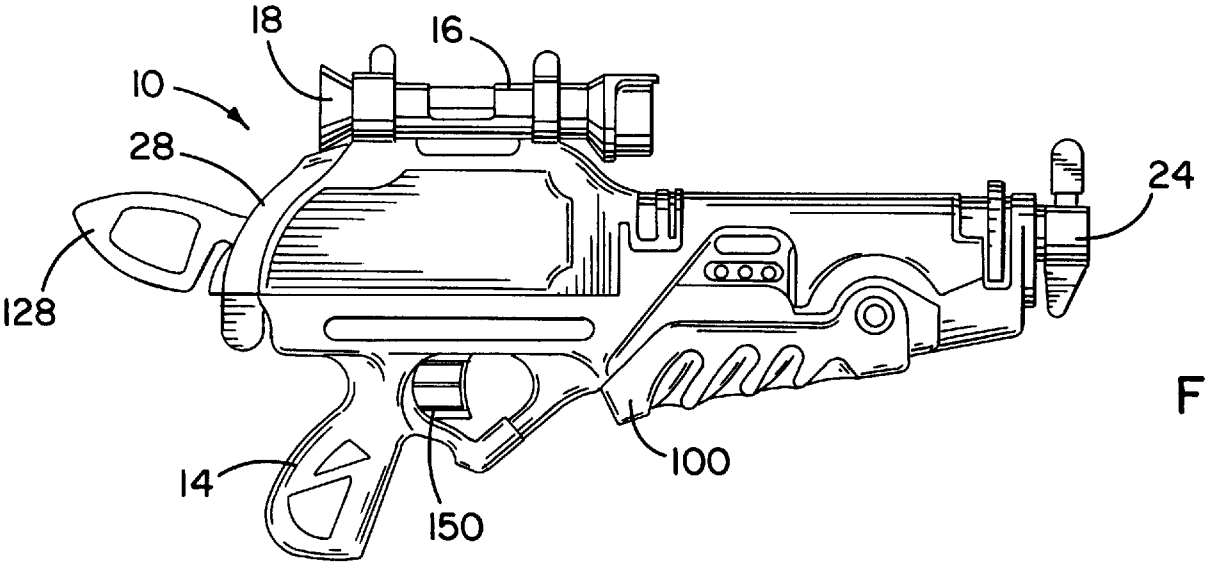
FIG. 3 is a left side view of the toy gun of FIG. 1.
Figure 4:
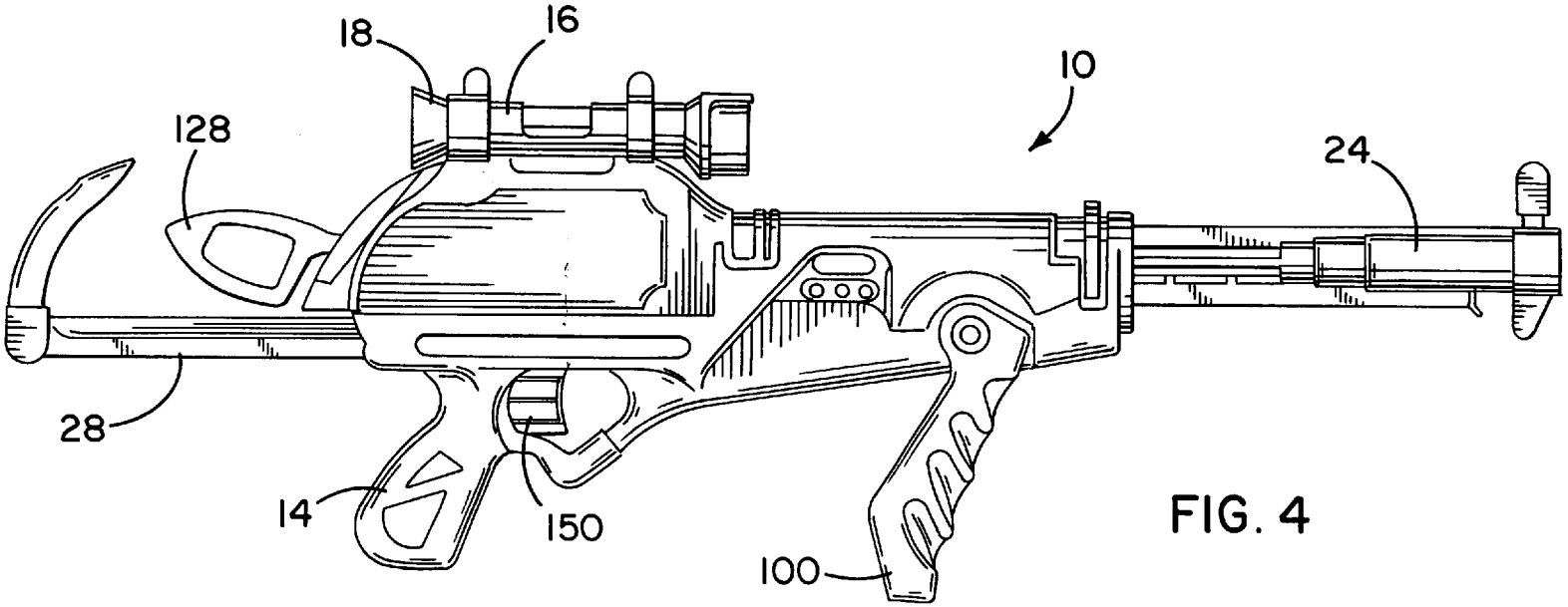
FIG. 4 is a view similar to FIG. 3, but showing the barrel and stock of the gun in their extended positions.

As shown in FIGS. 3 and 4, the toy gun 10 is provided with a barrel 24 coupled to the housing 12 for substantially linear movement between a retracted position (shown in FIG. 3) and an extended position (shown in FIG. 4). As also shown in FIGS. 3 and 4, the toy gun 10 is provided with a stock 28. Like the barrel 24, the stock 28 is coupled to the housing 12 for substantially linear movement between a stock retracted position (FIG. 3) and a stock extended position (FIG. 4). Thus, the toy gun 10 can take on the appearance of two separate toy weapons, namely, a pistol-like device wherein the barrel 24 and the stock 28 are substantially disposed within the housing 12 (see FIG. 1), and a AK-47 rifle-like device (see FIG. 2) wherein the barrel 24 and the stock 28 are located substantially outside the housing 12. As illustrated in FIGS. 2 and 4, the barrel 24 is located at a distal end of the housing 12 and the stock 28 is located at a proximal end of the housing 12 such that, when the barrel 24 and stock 28 are in their extended positions, they extend from opposite ends of the housing 12.

Figure 9:
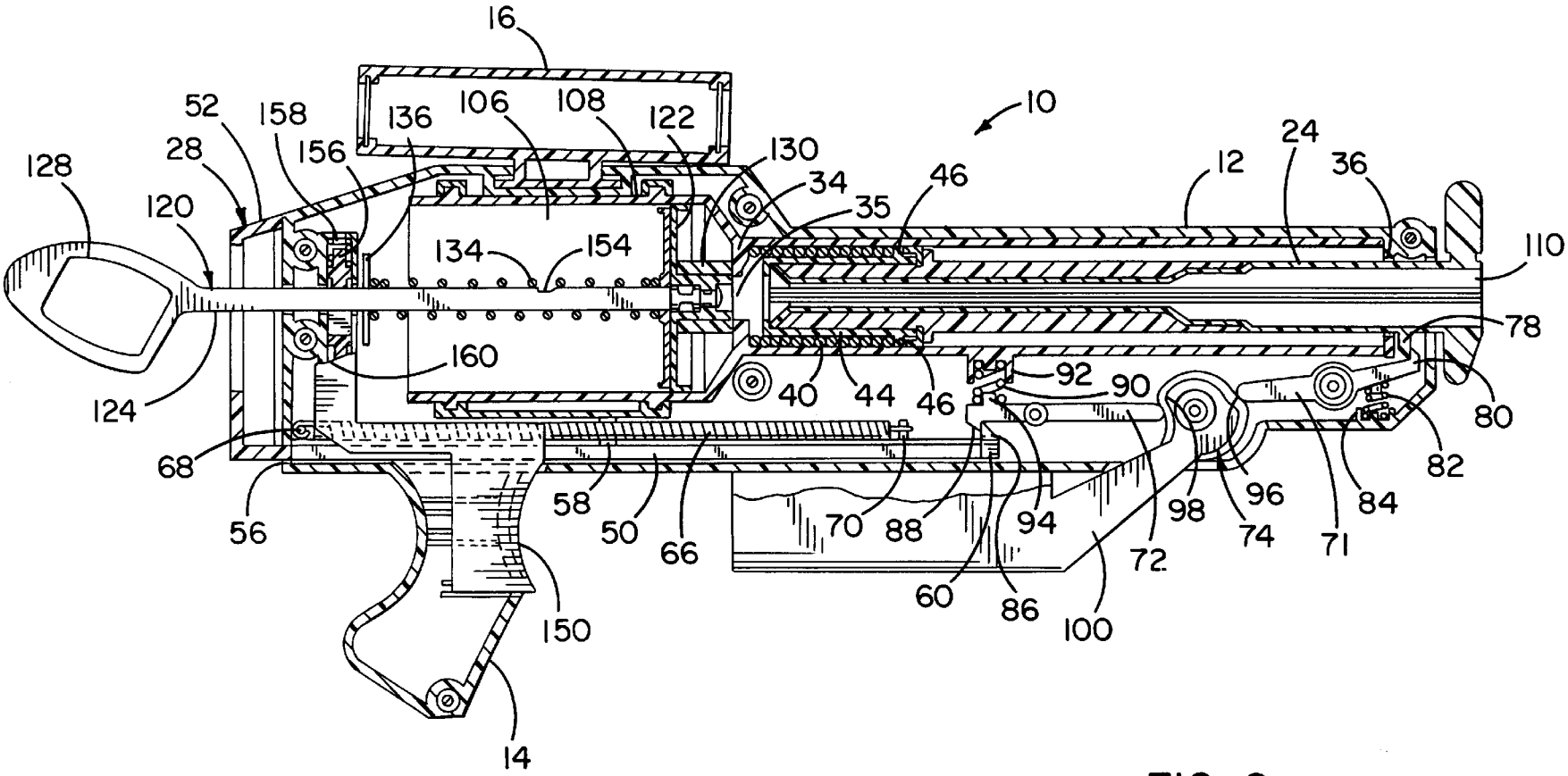
FIG. 9 is a cross-sectional view of the gun of FIG. 1.
Figure 10:
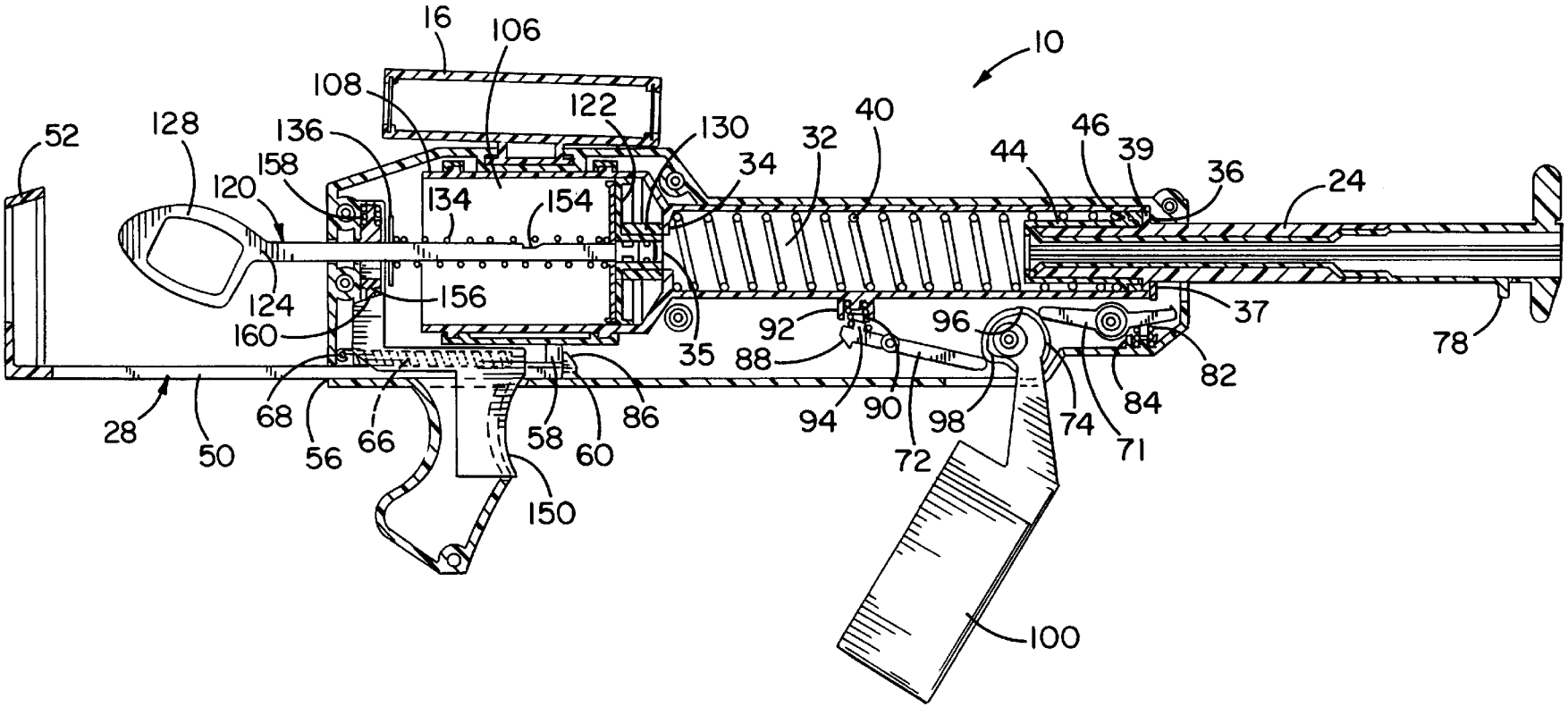
FIG. 10 is a view similar to FIG. 9 but showing the gun with its barrel and stock extended.

As shown in FIGS. 9–10, the housing 12 defines a barrel chamber 32. The barrel chamber 32 includes a proximal wall 34 defining a central aperture 35 and a distal wall 36 also defining a central aperture 37. The apertures 35, 37 are in substantial alignment. The chamber 32 is sized to slidably receive substantially all of the barrel 24 when the barrel is in the retracted position (see FIGS. 9 and 11). The aperture 37 in the distal wall 36 is sized to slidably receive the barrel 24, preferably with minimal frictional resistance. As shown in FIG. 10, the barrel 24 includes an annular ring 39 projecting from its surface for abutting the distal wall 36 to prevent the barrel 24 from passing completely through the aperture 37 thereby limiting forward movement of the barrel 24. The interaction of the annular ring 39 and the distal wall 36 defines the extended position of the barrel 24.

Figure 11:
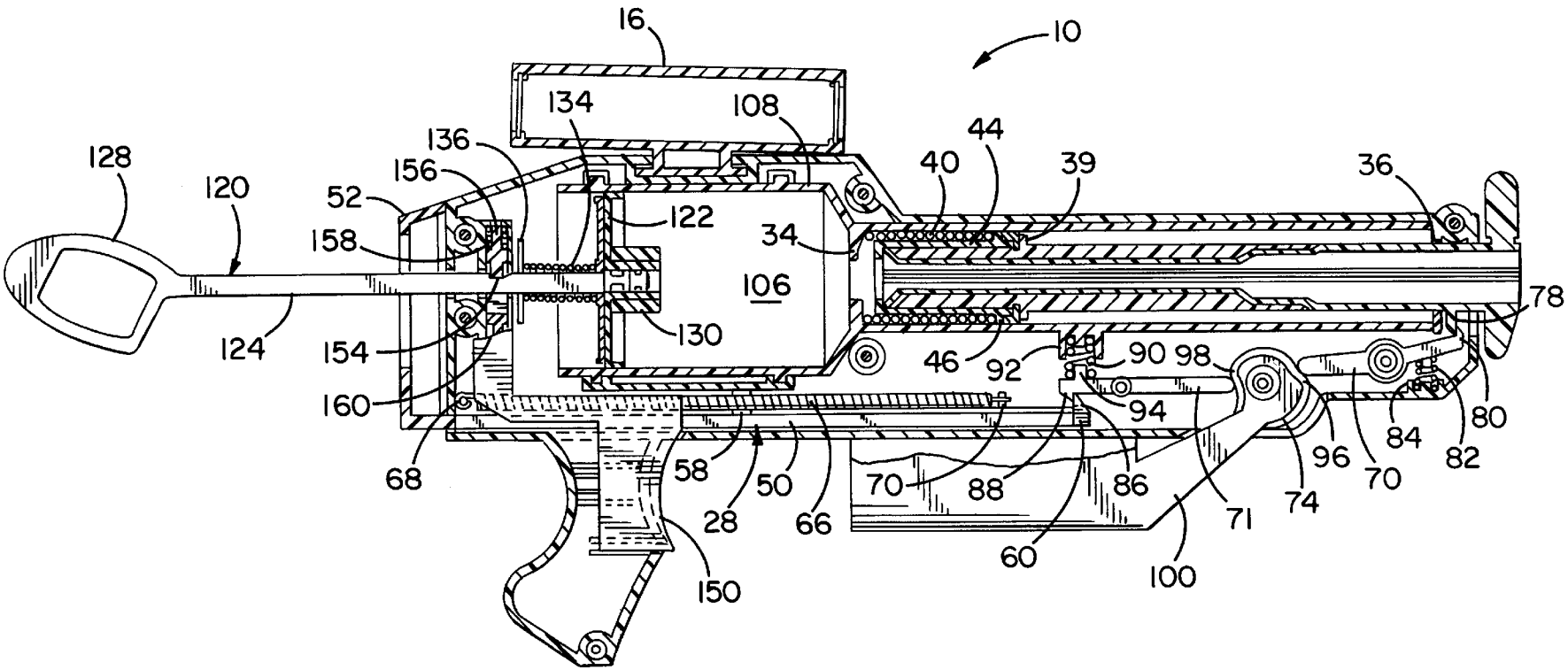
FIG. 11 is a view similar to FIG. 9, but illustrating the plunger in the cocked position.

To bias the barrel 24 towards the extended position, the gun 10 is provided with a barrel spring 40 disposed within the barrel chamber 32. As most easily seen in FIG. 10, the proximal end of the barrel spring 40 abuts the proximal wall 34 of the chamber 32. The spring 40 is preferably sized to receive the proximal end of the barrel 24 as shown in FIGS. 9–11. As explained in further detail below, an annular seal 44 is mounted on the proximal end of the barrel 24. The annular seal 44 includes a projecting ring 46 at its distal end. The distal end of the barrel spring 40 abuts the projecting ring 46 such that, when the barrel 24 is in its retracted position, the spring 40 is compressed between the proximal wall 34 of the barrel chamber 32 and the projecting ring 46 (see FIGS. 9 and 11) of the seal 44.

As most easily seen in FIG. 10, the stock 28 preferably comprises a shank 50 and a shoulder rest 52. As shown in FIG. 9, the shank 50 is disposed for reciprocating movement within the housing 12. The shank 50 mates with an aperture 56 defined in the proximal end of the housing 12 such that the shoulder rest 52 remains outside the housing 12 in both the stock extended and stock retracted positions.

Figure 7:
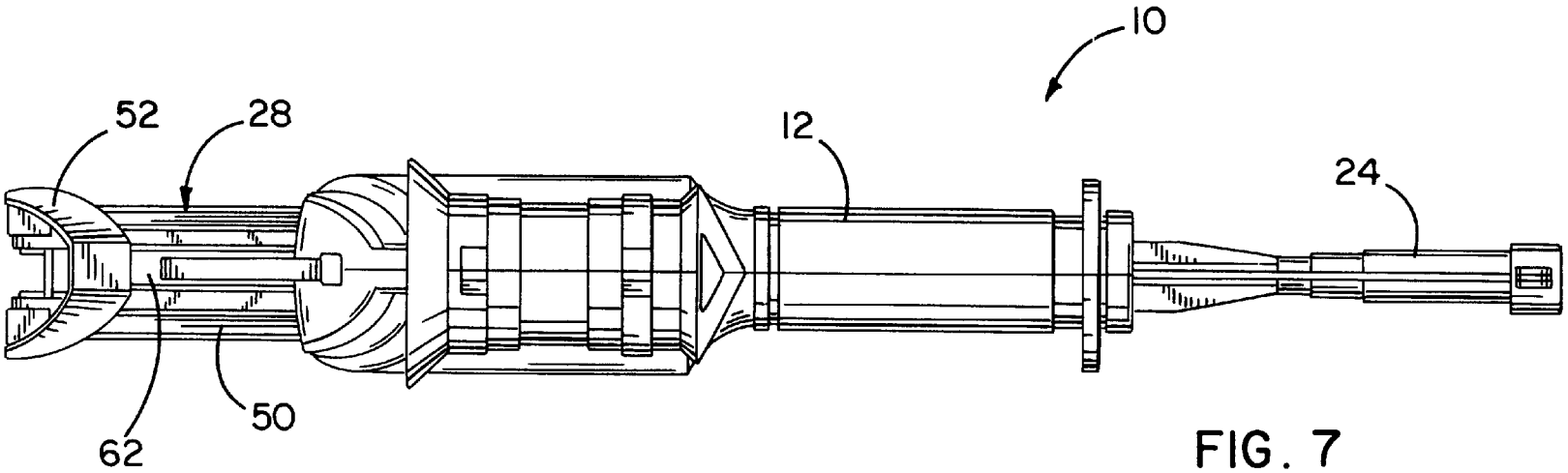
FIG. 7 is a top view of the device of FIG. 1.
Figure 8:
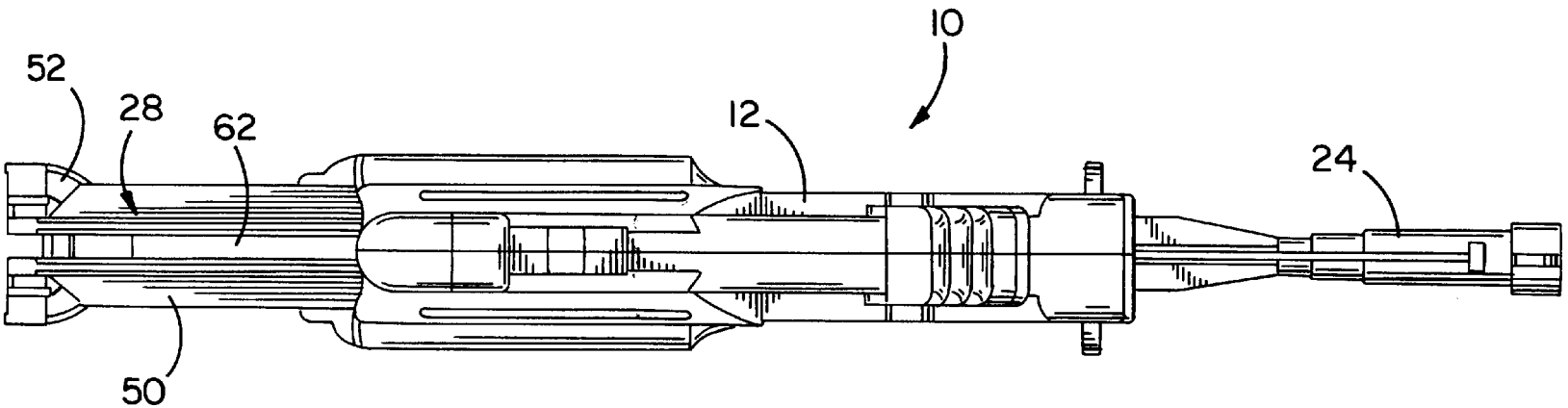
FIG. 8 is a bottom view of the device of FIG. 1.

To limit proximal movement of the stock 28 and to thereby define the stock extended position, the housing 12 includes a post 58 and the shank 50 of the stock 28 includes a distal wall 60 (see FIG. 10). As shown in FIGS. 7 and 8, the shank 50 of the stock 28 defines a central slot 62 extending along its longitudinal axis. The post 58 is located within the slot 62 to permit longitudinal movements of the shank 50 between the stock extended and stock retracted positions. The distal end of the slot 62 is defined by the distal wall 60 of the shank 50.

For the purpose of biasing the stock 28 toward the stock extended position, the toy gun 10 is provided with a stock spring 66. As most easily seen in FIGS. 9 and 11, the proximal end of the stock spring 66 is secured to a post 68 mounted on the housing 12, and the distal end of the spring 66 is secured to a post 70 mounted on the shank 50 of the stock 28. When the stock 28 is in the stock retracted position, the stock spring 66 is stretched between the posts 68, 70 such that the stock 28 is biased towards the stock extended position.

In order to selectively release the barrel 24 and the stock 28 to respectively move under the force of the springs 40, 66 to the extended and stock extended positions, the toy gun 10 is provided with a latching apparatus. As shown in FIG. 9, the latching apparatus includes two pivot arms 71, 72, and a compound latch 74. The pivot arms 71, 72 and the compound latch 74 are all independently pivotably mounted on posts secured to the housing 12. The pivot arms 71, 72 are mounted on opposite sides of the compound latch 74.

As shown in FIG. 9, the distal most pivot arm 71 comprises a barrel latch for releasably securing the barrel 24 in the retracted position. To this end, the barrel 24 includes an extension 78 which operatively engages a hook 80 on the distal end of the pivot arm 71 when the pivot arm is in the latched position shown in FIG. 9 and the barrel 24 has been forced into the retracted position. As also illustrated in FIG. 9, a biasing spring 82 is secured in a seat 84 defined in the housing 12 beneath the distal end of the pivot arm 71 to bias the arm 71 into the latched position.

The other pivot arm 72 comprises a stock latch for releasably securing the stock 28 in the stock retracted position. To this end, the distal wall 60 of the shank 50 of the stock 28 includes a projection 86 which operatively engages a hook 88 on the proximal end of the pivot arm 72 when the pivot arm 72 is in the latched position shown in FIG. 9 and the stock 28 has been forced into the stock retracted position. As shown in FIGS. 9 and 11, a biasing spring 90 is secured in a seat 92 defined in the housing 12 above the proximal end of the pivot arm 72 to bias the arm 72 into the latched position. To additionally secure the spring 40 within the seat 92, the pivot arm 72 preferably includes a post 94 opposite the hook 88.

The distal end of the pivot arm 72 and the proximal end of the pivot arm 71 operatively engage opposite sides of the compound latch 74. In particular, the compound latch 74 has a distal surface indentation which operatively engages the proximal end of the distal pivot arm 71, and a proximal surface indentation which operatively engages the distal end of the proximal pivot arm 72. The indentations respectively form a ledge 96 beneath the distal pivot arm 71 and a ledge 98 above the proximal pivot arm 72. Thus, when the compound latch 74 is pivoted counterclockwise about its pivot point, the ledges 96, 98 will respectively apply pivoting forces to the distal and proximal pivot arm 71, 72. When the compound latch 74 is sufficiently pivoted, the pivot arms 71, 72 will pivot in opposite directions about their axes such that the hooks 80, 88 respectively disengage the projections 78, 86 to thereby release the barrel 24 and the stock 28. When so released, the barrel 24 moves from the retracted position to the extended position under the force of spring 40, and the stock 28 moves from the stock retracted position to the stock extended position under the force of spring 66.

To facilitate pivoting of the compound latch 74, the compound latch 74 is preferably integrally formed with a forward handle 100. As shown in FIGS. 1 and 2, the handle 100 is pivotably mounted on the housing 12. It can be pivoted between a first position wherein the handle 100 lies against the housing 12 and a second position wherein the handle 100 can be used as a forward grip. Since pivoting the handle 100 pivots the compound latch 74, pivoting the handle 100 through a predefined angle releases both the barrel 24 and the stock 28 for movement to their extended positions. Thus, the handle 100 provides a single actuator for releasing the barrel and stock to move to their extended positions.

In the preferred embodiment, the toy gun 10 is adapted to shoot harmless projectiles via a blast of air. To this end, the housing 12 defines an air chamber 106. As shown in FIG. 9, the air chamber 106 is preferably defined by a cylindrical body or can 108 mounted within the housing 12 having an open proximal end and a conical distal end. In the illustrated embodiment, the conical distal end of the can 108 is truncated by, and integral to, the proximal wall 34 of the barrel chamber 32. Thus, the central aperture 35 of the distal wall 34 provides a channel between the air chamber 106 and the barrel chamber 32.

As shown in FIG. 9, the barrel 24 is cylindrical and defines a central lumen 110. When the barrel 24 is in the retracted position, the proximal end of the barrel 24 is disposed adjacent the central aperture 35. Thus, the proximal end of the lumen 110 is in communication with the air chamber 106 via the aperture 35. The distal end of the barrel 24 is sized to receive a projectile 112.

A preferred projectile 112 is shown in FIG. 12. The projectile 112 preferably comprises a cylindrical body 114 defining a central lumen 116. The proximal end of the lumen 116 is open to receive air rushing through the lumen 110 of the barrel 24. The distal end of the projectile 112 is substantially sealed by a pliable cup 118 made of rubber or the like. When a blast of air passes through the barrel 24 and into the projectile lumen 116, the interaction of the forced air and the sealed end of the lumen 116 propels the projectile 112 out of the barrel 24 in a known manner. To ensure adequate projectile force, the projectile body 114 is preferably sized to match the inner diameter of the distal end of the barrel lumen 110 such that most of the air passing through the barrel 24 enters the lumen 116 of the projectile 112.

For the purpose of developing a force sufficient to expel the projectile 112 from the barrel 24, the gun 10 is provided with means for forcing air from the chamber 106. In the illustrated embodiment, the forcing means comprises a plunger 120 arranged for movement between a cocked position (see FIG. 11) and a fired position (see FIGS. 9 and 10). As shown in FIG. 9, the distal end of the plunger 120 preferably includes a circular head 122 which is sized to slidingly engage the inner cylindrical surface defining the chamber 106. The plunger further includes a shaft 124. The proximal end of the shaft 124 is preferably formed as a manually engageable loop 128 to facilitate movement of the plunger 120 from the fired position to the cocked position. The distal end of the shaft 124 is coupled to the circular head 122.

As shown in FIGS. 9–11, the plunger 120 includes a spacer 130. Spacer 130 is located distally of the circular head 122 and is located to abut the proximal wall 34 of the barrel chamber 32 when the plunger 120 is in the fired position. The length of the spacer 130 is selected such that the circular head 122 reciprocates within the cylindrical area of the can 108 and does not enter the truncated conical section at the distal end of that structure.

The plunger 120 is biased towards the fired position by a plunger spring 134 mounted concentrically on the shaft 124. As shown in FIGS. 9 and 11, the spring 136 is compressible between an abutment 136 and the circular head 122. When a user pulls the plunger 120 proximally, the spring 136 compresses. When released, the spring 136 forces the plunger 120 distally such that the circular head 122 forces air from the air chamber 106, out through aperture 35, into the barrel 24 and into projectile 112.

For the purpose of ensuring a substantial portion of the air expelled from the air chamber 106 by the air forcing means is communicated through the barrel 24 to a projectile 112, the toy gun 10 is provided with a seal 44. As discussed above, the seal 44 includes a projecting ring 46 on its outer surface. The projecting ring 46 forms an air seal with the inner surface of the barrel chamber 72. As also discussed above, the seal 44 is mounted on the proximal end of the barrel 24. Thus, the seal 44 moves with the barrel 24 between the extended and retracted positions. As a result, the seal 44 is operational to ensure the air forced from the chamber 106 enters the barrel 24 regardless of the position of the barrel 24. As a result, the gun 10 can fire the projectile 112 when the barrel 24 is in either the extended position or the retracted position.

To selectively release the plunger 120 to move from the cocked position to the fired position, the toy gun 10 is provided with a trigger 150. As most easily seen in FIGS. 9 and 10, the shaft 124 of the plunger 120 includes a rectangular depression 154. As also shown in FIG. 9, the shaft 124 passes through an annular lock 156. When the shaft 124 is moved proximally a sufficient distance, the annular lock 156 moves downward under the force of spring 158 to mate with this depression 154 thereby preventing the shaft 124 from further movement. The position at which the annular lock 156 enters the depression 154 defines the cocked position of the plunger 120.

As shown in FIG. 9, the trigger 150 includes a camming surface 160 in operative engagement with the lowermost surface of the annular lock 158. When the trigger 150 is pulled proximally, the camming surface 160 also moves proximally thereby forcing the annular lock 158 upwards. If the trigger 150 is pulled proximally a sufficient distance, the camming surface 150 moves the lock 158 out of the depression 154 and the plunger 120 moves to the fired position under the force of spring 134.

Although other materials can be used without departing from the scope of the invention, except for the springs mentioned above, in the preferred embodiment, the components of the gun 10 are preferably constructed from plastic unless otherwise noted. Although other materials could be used without departing from the scope of the invention, in the preferred embodiment, the body 114 of the projectile comprises a polyurethane foam and the suction-cup end 118 comprises rubber.

Although certain instantiations of the teachings of the invention have been described herein, the scope of coverage of this patent is not limited thereto. On the contrary, this patent covers all instantiations of the teachings of the invention fairly falling within the scope of the appended claims either literally or under the doctrine of equivalents.

What is claimed is:

1. A toy gun comprising:

a housing defining a chamber;

means for forcing air from the chamber;

a barrel having a first end in communication with the chamber and a second end opposite the first end, the second end being adapted for receiving a projectile, the first end being in communication with the second end, the barrel being coupled to the housing for movement between a retracted position and an extended position;

a seal associated with the barrel for ensuring a substantial portion of the air forced from the chamber by the forcing means is communicated through the first end to the second end of the barrel for applying forced air to a received projectile;

a stock coupled to the housing for movement between a stock retracted position and a stock extended position; and, a stock spring for biasing the stock towards the stock extended position.

2. A toy gun as defined in claim 1 wherein the forcing means comprises a plunger arranged for movement between a cocked position and a fired position, the plunger being adapted to force air from the chamber as it moves from the cocked position to the fired position.

3. A toy gun as defined in claim 2 further comprising a trigger for selectively releasing the plunger to move from the cocked position to the fired position.

4. A toy gun as defined in claim 1 wherein the barrel is substantially disposed within the housing when the barrel is located in the retracted position.

5. A toy gun as defined in claim 1 wherein the barrel is substantially disposed outside of the housing when the barrel is located in the extended position.

6. A toy gun as defined in claim 1 wherein the movement of the barrel between the extended and retracted positions is substantially linear.

7. A toy gun as defined in claim 1 further comprising a barrel spring positioned within the housing to bias the barrel towards the extended position.

8. A toy gun as defined in claim 7 further comprising a barrel latch for releasably securing the barrel in the retracted position.

9. A toy gun as defined in claim 8 further comprising a latch in operative engagement with the barrel latch for selectively releasing the barrel for movement from the retracted position to the extended position.

10. A toy gun as defined in claim 9 wherein the latch is coupled to a handle, the handle is pivotably mounted on the housing, and pivoting the handle through a predefined angle releases the barrel for movement from the retracted position to the extended position.

11. A toy gun as defined in claim 1 further comprising a stock latch for releasably securing the stock in the stock retracted position.

12. A toy gun as defined in claim 11 further comprising a latch in operative engagement with the stock latch for selectively releasing the stock for movement from the stock retracted position to the stock extended position.

13. A toy gun as defined in claim 12 wherein the latch is coupled to a handle, the handle is pivotably mounted on the housing, and pivoting the handle through a predefined angle releases the stock for movement from the stock retracted position to the stock extended position.

14. A toy gun as defined in claim 11 further comprising a barrel latch for releasably securing the barrel in the retracted position.

15. A toy gun as defined in claim 14 further comprising a compound latch in operative engagement with the stock latch for selectively releasing the stock for movement from the stock retracted position to the stock extended position and in operative engagement with the barrel latch for selectively releasing the barrel for movement from the retracted position to the extended position.

16. A toy gun as defined in claim 15 wherein the compound latch is coupled to a handle, the handle is pivotably mounted on the housing, and pivoting the handle through a predefined angle releases the stock for movement from the stock retracted position to the stock extended position and the barrel for movement from the retracted position to the extended position.

17. A toy gun as defined in claim 1 wherein the barrel is located at a distal end of the housing and the stock is located at a proximal end of the housing such that, when the barrel is in the extended position and the stock is in the stock extended position, the barrel and the stock extend from opposite ends of the housing.

18. A toy gun as defined in claim 1 wherein the seal is located on the barrel for movement therewith.

19. A toy gun as defined in claim 1 further comprising a projectile.

20. A toy gun comprising:

a housing;

a barrel coupled to the housing for movement between a retracted position and an extended position;

a stock coupled to the housing for movement between a stock retracted position and a stock extended position; and, a single actuator for selectively permitting the barrel to move to the extended position and the stock to move to the stock extended position.

21. A toy gun as defined in claim 20 wherein the barrel is substantially disposed within the housing when the barrel is located in the retracted position.

22. A toy gun as defined in claim 20 wherein the barrel is substantially disposed outside of the housing when the barrel is located in the extended position.

23. A toy gun as defined in claim 20 wherein the movement of the barrel between the extended and retracted positions is substantially linear.

24. A toy gun as defined in claim 20 further comprising a barrel spring positioned within the housing to bias the barrel towards the extended position.

25. A toy gun as defined in claim 24 further comprising a barrel latch for releasably securing the barrel in the retracted position.

26. A toy gun as defined in claim 25 further comprising a stock spring for biasing the stock towards the stock extended position.

27. A toy gun as defined in claim 26 further comprising a stock latch for releasably securing the stock in the stock retracted position.

28. A toy gun as defined in claim 27 further comprising a compound latch in operative engagement with the stock latch for selectively releasing the stock for movement from the stock retracted position to the stock extended position and in operative engagement with the barrel latch for selectively releasing the barrel for movement from the retracted position to the extended position.

29. A toy gun as defined in claim 28 wherein the compound latch is coupled to a handle, the handle is pivotably mounted on the housing, and pivoting the handle through a predefined angle releases the stock for movement from the stock retracted position to the stock extended position and the barrel for movement from the retracted position to the extended position.

30. A toy gun as defined in claim 20 wherein the barrel is located at a distal end of the housing and the stock is located at a proximal end of the housing such that, when the barrel is in the extended position and the stock is in the stock extended position, the barrel and the stock extend from opposite ends of the housing.

31. A toy gun as defined in claim 20 wherein the stock is substantially disposed within the housing when the stock is located in the retracted position.

32. A toy gun as defined in claim 20 wherein the stock is substantially disposed outside of the housing when the stock is located in the extended position.

33. A toy gun as defined in claim 20 further comprising a projectile.

34. For use in a toy gun having first and second movable elements, the first element being movable between first and second positions and the second element being movable between third and fourth positions, an apparatus comprising:

a first pivot arm in operative engagement with the first element to releasably secure the first element in the first position;

a second pivot arm in operative engagement with the second element to releasably secure the second element in the third position; and a compound latch having a first surface in operative engagement with the first pivot arm and a second surface in operative engagement with the second pivot arm, the first and second surfaces being located such that, when the compound latch is sufficiently pivoted, the first surface applies a pivoting force to the first pivot arm and the second surface applies a pivoting force to the second pivot arm to thereby cause the first and second pivot arms to release the first and second elements for movement to the second and fourth positions, respectively.

35. An apparatus as defined in claim 34 wherein the first element comprises a barrel for the toy gun and the second element comprises a stock for the toy gun.

36. An apparatus as defined in claim 35 wherein the barrel is spring biased towards the second position, and the stock is spring biased towards the fourth position.

37. An apparatus as defined in claim 35 wherein the first position comprises a retracted position, the second position comprises an extended position, the third position comprises a stock retracted position, and the fourth position comprises a stock extended position.

* * * * *